US006065752A

United States Patent [19]

Beltran

[11] Patent Number: 6,065,752

[45] Date of Patent: May 23, 2000

[54] METHOD OF PLAYING A WAGERING BOARD CARD GAME WITH A PROGRESSIVE JACKPOT

[75] Inventor: Rodrigo S. Beltran, Rahway, N.J.

[73] Assignee: Kevin Schuele, Whitefish Bay, Wis.

[21] Appl. No.: 09/300,497

[22] Filed: Apr. 28, 1999

[51] Int. Cl.[7] ..... A63F 3/08

[52] U.S. Cl. ..... 273/274; 273/292

[58] Field of Search ..... 273/292, 236, 273/271, 309, 274; 463/12

[56] References Cited

U.S. PATENT DOCUMENTS

| | | | |
|---|---|---|---|
| 1,532,722 | 4/1925 | Wall | 273/292 |
| 3,998,462 | 12/1976 | Gootl . | |
| 4,362,303 | 12/1982 | Pell . | |
| 4,651,997 | 3/1987 | Wood | 273/274 |
| 5,265,881 | 11/1993 | Doherty | 273/274 |
| 5,529,309 | 6/1996 | Bartlett | 273/292 |
| 5,540,442 | 7/1996 | Orselli et al. . | |
| 5,632,487 | 5/1997 | Nguyen | 273/292 |
| 5,639,092 | 6/1997 | Macaisa . | |
| 5,673,917 | 10/1997 | Vancura | 273/292 |
| 5,702,106 | 12/1997 | Alvarez, Jr. | 273/292 |
| 5,772,211 | 6/1998 | Nazaryan | 273/292 |
| 5,839,730 | 11/1998 | Pike | 273/292 |
| 5,839,731 | 11/1998 | Feola | 273/292 |
| 5,865,437 | 2/1999 | Moore, Jr. | 273/292 |
| 5,882,009 | 3/1999 | Schaefer | 273/292 |
| 5,918,884 | 7/1999 | DiMuro | 273/292 |

*Primary Examiner*—Jeanette Chapman
*Assistant Examiner*—M. Chambers
*Attorney, Agent, or Firm*—Ezra Sutton

[57] ABSTRACT

A method of playing a wagering game wherein a plurality of players place bets on a wagering board or table on which surface is laid out an arrangement or set of joined 2-card combinations called "duos" of ordinary playing cards formed from a deck of conventional playing cards preferably the poker type or replica thereof. The dealer is provided with a deck of conventional playing cards with suits and ranks that are identical to the cards on the wagering board. The dealer shuffles the deck as the players are placing their bets on the wagering board. After all bets are placed, the dealer draws the first two cards, one at a time, from the deck, lay them face up on the table, next to one another, and inspect them if they form a combination that matches any one of the duos on the wagering board. If a match is made, the matched duo is declared the winner, and the winners paid according to a payout schedule. The game ends and the cards are reshuffled for the next game. If no match is made, the game continues with the dealer drawing one card at a time from the deck, laying it face up on the table next to the last exposed card, comparing each time if the last card drawn in combination with one of the previously exposed cards forms a combination that matches any one of the duos laid out on the board, and continuing to do so until a match is made. The matched duo is declared the winner and all winning bets paid according to a payout schedule. The game ends and the cards reshuffled for the next game.

6 Claims, 3 Drawing Sheets

METHOD OF PLAYING A WAGERING BOARD CARD GAME WITH A PROGRESSIVE JACKPOT

FIELD OF THE INVENTION

A method of playing a wagering board card game with a progressive jackpot wherein a plurality of players place bets on a wagering board having an arrangement of 2-card combinations called "duos" made from a standard deck of playing cards.

BACKGROUND OF THE INVENTION

For many years, it has been man's continuous attraction to wagering games of chance that significantly contributed to the development of the gaming industry. The rapid growth of the business and increased competition, particularly the casino type, has created opportunities to develop new games to keep the interest of current players and develop new ones. Most of the currently available wagering games and their variations, with some exceptions, deal with rules of varying complexities and players' skills that intimidate some people from trying certain types of casino games. A game that has rules which are easy to understand by a wide variety of players, that offers several wagering variations with multiple opportunities of winning, including multiple chances of winning a progressive jackpot, and can be played at a relatively fast wager resolution conclusion enhances the interest and excitement of even the novice players.

The various wagering games currently in existence, whether in public domain or patented, for the most part, do not have the combined elements of simplicity, excitement, the several wagering variations and the multiple opportunities of winning a progressive jackpot that are offered by the present invention.

Blackjack, baccarat, and poker type games and their variations where the rankings and numerical values are assigned to each card, with some exceptions, require skill levels and strategic decision- making where a momentary lapse of concentration can be detrimental to a player's pursuit.

There are various games with multiple wagering opportunities and jackpots. These games are generally modifications and variations of standard games of poker, blackjack, craps, baccarat, and roulette.

DESCRIPTION OF THE PRIOR ART

Wagering games having various methods of playing, designs and functions have been disclosed in the prior art. For example, U.S. Pat. No. 5,431,407, issued to Hofberg et al., discloses a method of matching a card in an ordered sequence from cards opened one at a time from a deck where the house or casino wins if a match is made and the players win if the game sequence is completed without a match. The game and apparatus which has attributes similar to craps, requires new sets of rules that may take time for players, especially the novice ones, to learn and understand.

While the above prior art game is cited, the present invention is a novel wagering game, and no prior art game is directly applicable to the present invention.

Accordingly, it is an object of the present invention to provide a novel wagering card game having a wagering board and betting chips for betting on 2-card combinations that match playing cards dealt by the dealer, that can be played at gaming establishments, casinos, social gatherings, or in a home environment by a family using a standard deck of conventional playing cards.

Another object of the present invention is to provide a novel wagering card game, for betting on 2-card combinations that match playing cards dealt by the dealer, which can be played at casinos or gaming establishments, or at home as a regular board game for family enjoyment, or by utilizing existing electronic media technologies such that one or more individuals can use standard computers and software programs, video display units, video games, CD-ROM discs, laser disc games and the like for playing the game.

Another object of the present invention is to provide a wagering card game that includes all the possible, random 2-card combinations or duos that can be generated from a deck of conventional playing cards having the deletion, substitution, or addition and use of other cards with special symbols (i.e. jokers) which will alter the number of possible random 2-card combinations or duos.

Another object of the present invention is to provide a wagering game that offers the players the opportunity to make several wagering combinations with different payout odds including multiple opportunities to win or share a progressive jackpot every time a new game is played.

A further object of the present invention is to provide an exciting and interesting wagering game that is novel, yet easy to understand for the players to enjoy.

SUMMARY OF THE INVENTION

The wagering game of the present invention can be played by a plurality of players against a gaming establishment or "banker". The game is comprised of a wagering board or gaming table on which a surface is laid out, printed, painted, or silk-screened an arrangement or set of 26 joined 2-cards combinations called "duos" of conventional playing cards, preferably the poker type, or replica thereof, which are formed from a deck of conventional playing cards. A separate deck of cards with suits and ranks that are identical to the cards on the wagering board is provided to be used during the game. The objective of the players is to bet correctly which one among the 26 duos on the wagering board will be the first to be matched by the cards drawn one at a time by the dealer from the deck.

As the cards are being shuffled by the dealer, the players make their bets on the wagering board in accordance with the betting layout in FIG. 3, where the placement or position of the bets on the board determine the type of bets made and the corresponding payout odds for the winning bets. The players have the option to make regular bets only, or combinations of jackpot and regular bets.

The players are given sufficient time to make their bets after the shuffle is completed. The dealer announces "No more bets", then proceeds to draw the first card from the deck and lay it face up on the table in full view of everyone. The dealer then draws the second card and lay it face up next to the first card. If the first two cards drawn matches any one of the 26 duos on the board, the matched duo is declared the winner. The dealer announces "matched a duo, game over" and places the marker on the adjoining edges of the winning duo on the board. All the losing bets are removed and all the wining bets are paid according to a specified payout schedule as determined by the position of the bets on the board.

If no duo on the board is matched by the first two cards drawn, the game continues with the dealer drawing one card at a time from the deck, and laying it face up on the table, until the last card drawn, which in combination with any one of the previously exposed cards, matches any one of the duos on the board. When a match is made, the dealer inspects if the match is formed by two cards that were consecutively drawn from the deck. If it is, the dealer inspects further if the winning duo is one of the designated jackpot duos. If it is, the dealer announces "matched a duo, jackpot" and places the marker on the adjoining edges of the winning duo. If the match is formed by two cards that were consecutively drawn but not one of the designated jackpot duos, the dealer announces "matched a duo, game over" and places the marker on the adjoining edges of the winning duo. If the match is formed by two cards that were not consecutively drawn, the dealer announces "matched a duo, game over" and places the marker on the first card drawn of the winning duo. The placement or position of the marker on the winning duo indicates to everyone whether there was a chance that the jackpot could have been won in the just-concluded game. All losing bets are removed with the losing jackpot bets segregated from the losing regular bets, a percentage of which is added to the jackpot for the next game. All the winning bets are paid according to a specified payout schedule as determined by the positions of the bets on the board. The whole deck is re-shuffled as the players make their bets for the next game.

An optional automatic shuffling device may be utilized to facilitate the speed of the game. A display device may also be included with the game apparatus to display the jackpot and other information pertaining to the game.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
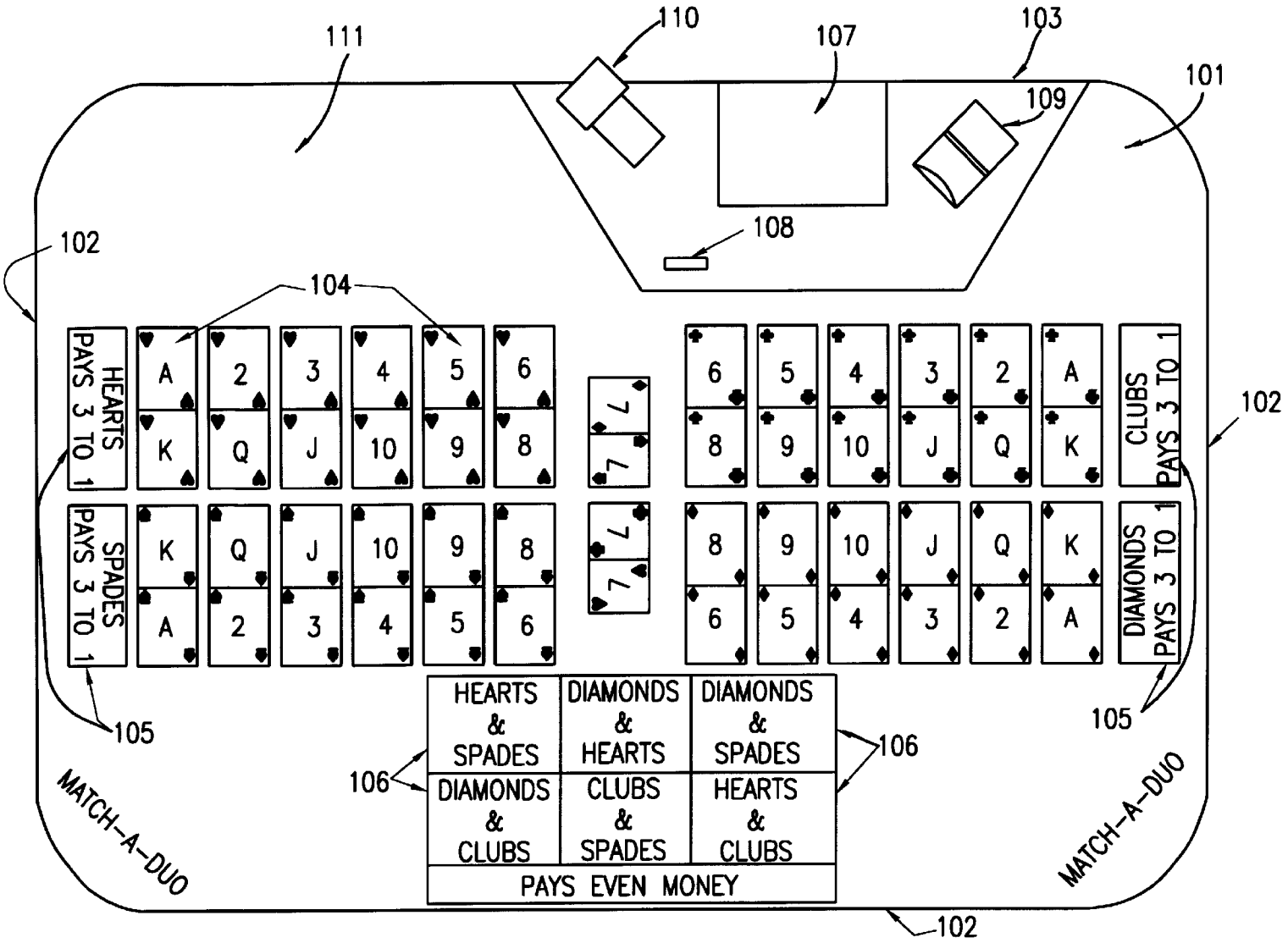
FIG. 1 depicts the plan view of the game board or table showing the layout and the apparatus used in playing the game of the present invention.

Discussion of the Game:

FIG. 1 is a plan view of the apparatus and layout used for playing the wagering game of the present invention. It includes a gaming table or board 101, which has a flat surface and maybe covered with felt or other appropriate material. The table has 3 sides 102, to accommodate as many players that can comfort ably fit on these sides and a fourth side 103, to accommodate the dealer. An arrangement or set of 26 joined 2-cards combinations called "duos" of conventional playing cards preferably the poker type or replica thereof 104, and additional indicia on which various wagering combinations maybe placed 105 and 106, are laid out, painted, printed, or silk screened on the surface of the table. The dealer position 103, includes an area for the cards being exposed during the game 107, and an area or slot for receiving all losing jackpot bets 108, which is connected to a counter that calculates the amount added to the progressive jackpot and a display that shows the amount of the current jackpot (not shown).

Optionally, the apparatus for playing the game of the present invention may include a dealing shoe 109, an automatic shuffling machine 110, and an area for keeping the casino-owned chips 111. A marker to indicate the winning duo and a display apparatus for the jackpot and other information related to the game may also be included (not shown).

Optionally, each player maybe provided with a set of distinct colored betting chips or tokens in order to distinguish each player's bets from one another.

Figure 2:
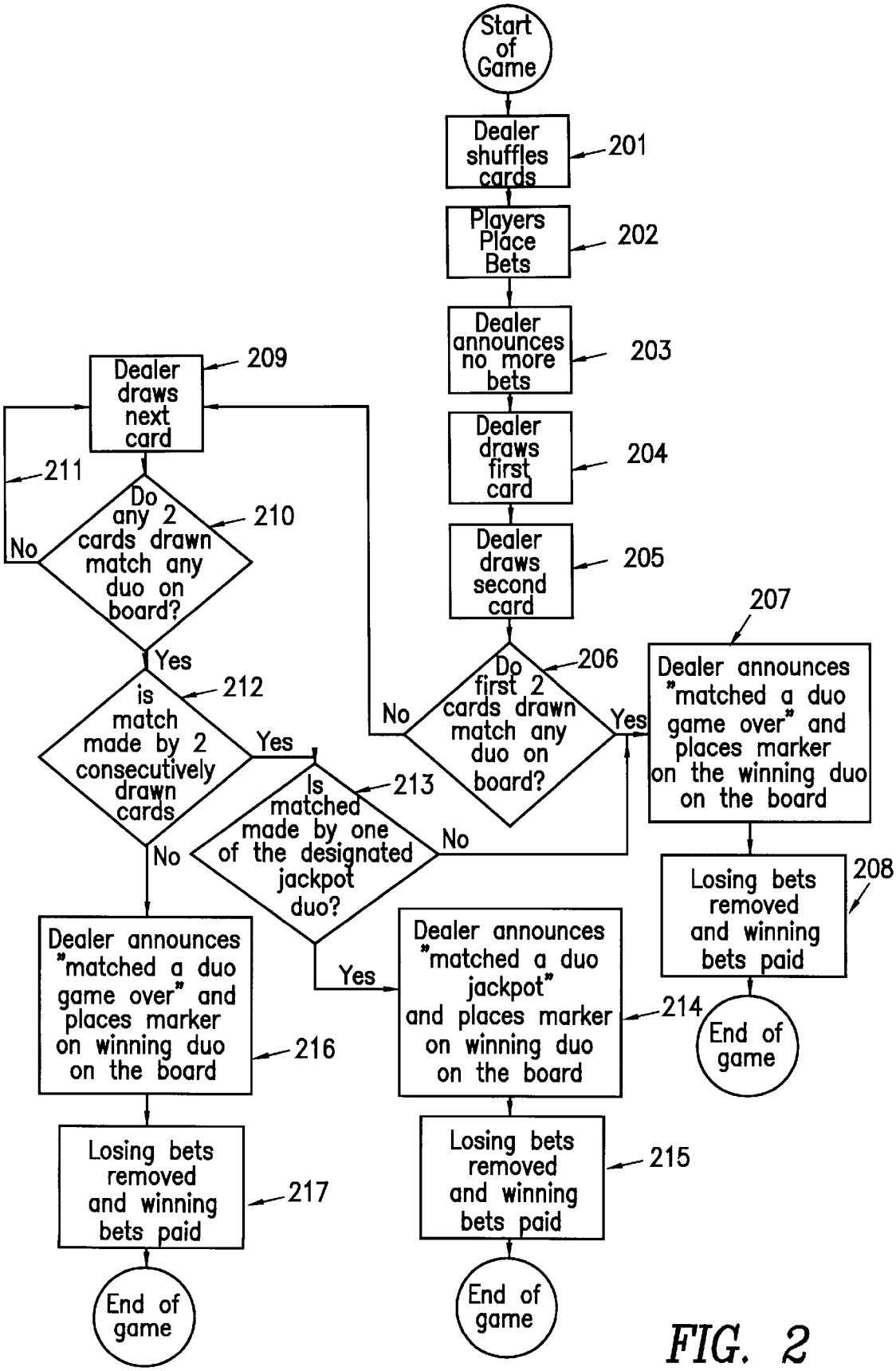
FIG. 2 is a flow chart depicting the flow of the game.

The flow of the game is represented by the block diagram shown in FIG. 2. The dealer is provided with a deck of ordinary playing cards with suits and ranks that are identical to the cards on the wagering board. The game starts with the dealer shuffling the deck of cards, block 201. As the cards are being shuffled, the players make their bets on any of the duos on the wagering board, block 202, in accordance with the examples in the betting layout in FIG. 3. The players have the option to make regular bets only, or combination of jackpot and regular bets. The different ways of making the various bets are explained in detail in subsequent sections of this description under the heading "DISCUSSION OF THE VARIOUS WAGERING COMBINATIONS".

The players are given sufficient time to make their bets after the shuffle is completed. The dealer announces "No more bets", block 203, then proceeds to draw the first card from the deck and lay it face up on the table in full view of everyone, block 204. The dealer then draws the second card from the deck and lay it face up next to the first card, block 205. The dealer inspects if the first two cards drawn matches any one of the duos on the wagering board, block 206. If there is a match, the dealer announces "matched a duo, game over" and then places the marker on the adjoining edges of the cards of the winning duo on the wagering board, block 207. The dealer removes all losing bets and pays all winning bets, block 208, in accordance with the placement or positioning of the winning bets on the wagering board and a specified payout schedule.

If there is no match between the first two cards drawn from the deck with any of the duos on the board, the game continues. The dealer then draws the next card from the deck and lays it face up next to the other exposed cards, block 209, and inspects if the last card drawn in combination with any of the previously exposed cards, make a combination that matches any one of the duos on the board, block 210. If no match is made, line 211, the dealer continues to draw one card at a time from the deck, lays it face up next to the other exposed cards until the last card drawn, which in combination with any one of the previously exposed cards, match any one of the duos on the wagering board. When a match is made, the dealer inspects if the match is formed by a combination of two cards that were consecutively drawn from the deck, block 212.

If it is, the dealer inspects further if the winning duo is formed by one of the designated jackpot duos. The number of jackpot duos has to be designated because the probability of winning the progressive jackpot or portion thereof, is dependent on the number of cards drawn prior to drawing the two consecutive cards designated as one of the jackpot duos. That is, the probability of winning the progressive jackpot or portion thereof, decreases as the number of cards drawn prior to drawing two consecutive cards that matches a duo on the board increases. For example, the probability of winning the progressive jackpot on the 26th and 27th cards is extremely low as compared to the probability of winning on the combination of the 25th and 26th cards, plus the probability of winning on the combination of the 26th and 27th cards.

It is intended for illustration purposes and for the remainder of the discussion of this game that the progressive jackpot combinations will consist of either one of the combinations of the 21st and 22nd cards, or the 22nd and the 23rd cards, or the 23rd and 24th cards, or 24th and 25th cards, or 25th and 26th cards, or 26th and 27th cards drawn, block 213. If it is, the dealer announces "matched a duo, jackpot" and places the marker on the adjoining edges of the cards of the winning duo on the wagering board, block 214. The dealer removes all losing bets and pays all winning bets, block 215, in accordance with the placement or positioning of the winning bets on the wagering board and a specified payout schedule.

If the match is formed by a combination of two cards that were consecutively drawn, but other than one of the designated jackpot combinations, e.g. the 1st and 2nd cards, or 2nd and 3rd cards, or 3rd and 4th, and so on up to the 20th and 21st cards drawn, the dealer announces "matched a duo, game over", and places the marker on the adjoining edges of the cards of the winning duo on the wagering board, block 207. The dealer removes all losing bets and pays all winning bets, block 208, in accordance with the placement or positioning of the winning bets on the wagering board and a specified payout schedule.

If the match is formed by a combination of two cards that were not consecutively drawn, from the deck, the dealer announces "matched a duo, game over" and places the marker on the first card drawn of the winning duo, block 216. The dealer removes all losing bets and pays all winning bets, block 217, in accordance with the placement or positioning of the winning bets on the wagering board and a specified payout schedule.

The placement or positioning of the marker on the winning duo indicates to everyone whether there was the likelihood that the jackpot could have been won on the just-concluded game. The whole deck is re-shuffled as the players are making their bets for the next game.

All losing jackpot bets at the end of each game is segregated from the losing regular bets and a percentage added to the progressive jackpot for the next game.

Figure 3:
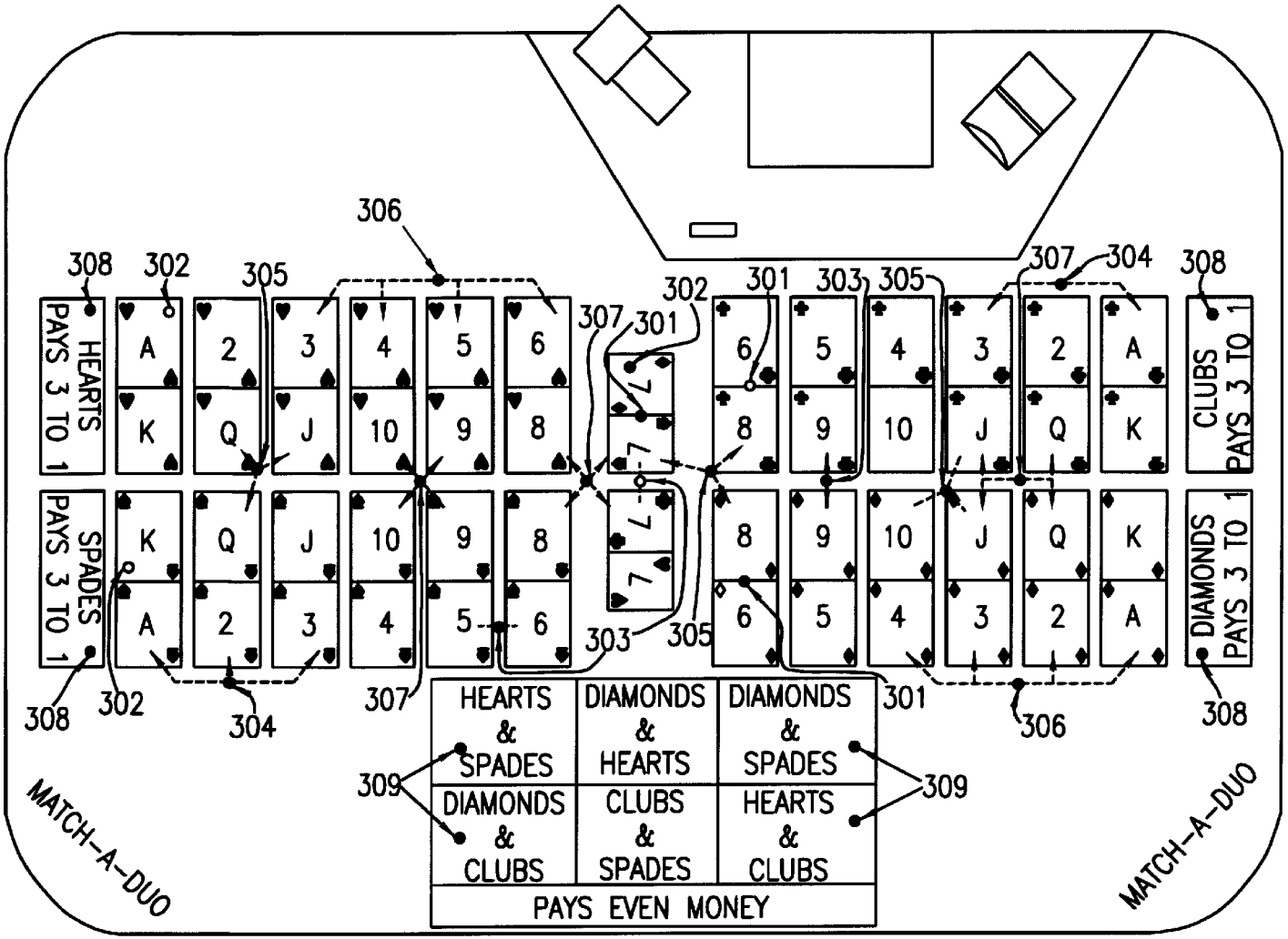
FIG. 3 is a plan view of the game layout depicting the different ways of placing the various wagering combinations that can be made in the game of the present invention.

Discussion of the Various Wagering Combinations;

The various wagering combinations and the corresponding payout odds are determined by the specific placement or positioning of the bets on the board as shown in the examples in FIG. 3 and as explained below:

1. Jackpot Duo Bets—An optional, fixed, pre-determined amount is placed on the adjoining edges of the duo that the players are betting on such that the bets straddle both cards of the duo. See Examples 301. These are bets that any of the duos on which the bets are placed will be the winning duo by being matched by two cards that are consecutively drawn from the deck that has been designated as one of the jackpot duos.

Variations of Regular Bets:

The regular bets are those bets that any one of the duos on the wagering board on which the bets are placed will be the winning duo by being matched by two cards drawn from the deck regardless of whether the cards were drawn consecutively or not.

2. Straight or Single Duo Bets—The bets are placed anywhere near, or at the center of any of the cards on the wagering board, but away from and without touching the adjoining edges of the duo the players are betting on to distinguish these bets from the jackpot bets. See Examples 302.

3. Split or Two Duo Bets—The bets are placed on the space between two adjacent duos which can be on the same or opposite rows. These bets cover the duos adjacent to the bets as indicated by the dotted lines with arrows in Examples 303.

4. Outside Three Duo Bets—The bets are placed on the outside space directly behind the middle duo of the three duos the players are betting on. These bets cover the duo directly opposite the bets plus one adjacent duo to the left and one adjacent duo to the right of the middle duo as indicated by the dotted lines with arrows in Examples 304.

5. Inside Three Duo Bets or L-Bets—The bets are placed touching the inside corner of the middle duo the players are betting on. These bets cover the duo the bets are placed on, plus the two duos adjacent to the bets in such a manner that two of the duos are on the same row and the third duo is in the opposite row directly opposite the middle duo thus forming the letter "L" as indicated by the dotted lines with arrows in Examples 305.

6. Outside Four Duos Bets—The bets are placed on the outside space of either row between two adjacent duos in such a manner that the bets are not directly opposite any specific duo. These bets cover the two duos adjacent to the bets, plus one duo each directly to the left and to the right of the middle adjacent duos as indicated by the dotted lines with arrows in Examples 306.

7. Inside Four Duos Bets—The bets are placed on the inside space between the two rows in such a manner that the bets are directly opposite any specific duo. These bets cover the four duos that are adjacently surrounding the bets as indicated by the dotted lines with arrows in Examples 307.

8. Six Duos or Same Suit Bets—The bets are placed on any of the indicia with the name of the four suits—Hearts, Spades, Clubs or Diamonds. These bets cover all the six duos in the same suit. For this following regular bet, the duos on the center of the board are not included or covered by bets of the players. See Examples 308.

9. Twelve Duos or Mixed Suit Bets—The bets are placed on any of the indicia with the name of the mixed suits—Hearts and Spades, Diamonds and Hearts, Spades and Clubs, and Clubs and Hearts. These bets cover the twelve duos of the mixed suits specified in the blocks where the bets are placed. For this following regular bet, the duos on the center of the board are not included or covered by bets of the players. See Examples 309.

Discussion of the Various Payout Odds

I. Jackpot Payout Schedule:

The jackpot is won if there are jackpot bets placed on the duo on the board that is matched by two consecutively drawn cards that is one of the designated jackpot duos. For this specific illustration, the match could be made by either one of the combinations of the 21st and the 22nd cards, or the 22nd and the 23rd cards, or the 23rd and 24th cards, or the 24th and 25th cards, or the 25th and the 26th cards, or the 26th and 27th cards.

If the jackpot bets are placed on the duo on the board that is matched by two consecutively drawn cards from the deck but other than one of the designated jackpot combinations, that is, for this illustration, by two consecutively drawn cards from the 1st and 2nd cards, or the 2nd and 3rd cards, or the 3rd and 4th cards, up to the 20th and 21st cards, the winners get a portion of the progressive jackpot according to a specified payout schedule.

The jackpot maybe won by a single player or shared by a plurality of players who make jackpot bets on the same winning jackpot duo in the same game.

The probability of winning the progressive jackpot or portion thereof, is dependent on and determined by the number of cards drawn prior to the drawing of the designated jackpot duos and maybe changed. For example the likelihood of generating a higher progressive jackpot maybe increased by designating the jackpot duos of either the 22nd and 23rd cards, or the 23rd and 24th cards, up to the 26th and 27th cards and changing the combinations for winning a portion of the jackpot accordingly.

The schedule listed below are to illustrate the payout for the designated combinations based on the probabilities of winning with such combinations and maybe changed:

| If The Jackpot Bets Matches: | The Winning Bets Win: |
|---|---|
| 21st and 22nd up to the 26th and 27th cards | Winning bets share 100% of Jackpot |
| 19th and 20th up to the 20th and 21st cards | Winning bets share 10–15% of Jackpot |
| 17th and 18th up to 18th and 19th cards | Each player wins $1,000.00–$1200.00 |
| 15th and 16th up to 16th and 17th cards | Each player wins $700.00–$800.00 |
| 13th and 14th up to 14th and 15th cards | Each player wins $400.00–$500.00 |
| 10th and 11th up to 12th and 13th cards | Each player wins $175.00–$250.00 |
| 7th and 8th up to 9th and 10th cards | Each player wins $80.00–$120.00 |
| 4th and 5th up to 6th and 7th cards | Each player wins $40.00–$60.00 |
| lst and 2nd up to 3rd and 4th cards | Each player wins $30.00–$35.00 |

II Regular Bets Payout Schedule:

The winning regular bets are paid independently of the winning jackpot bets and are paid out according to the placement or position of the bets on the wagering board and irrespective of the sequence or order in which the cards of the winning duo are drawn from the deck.

| Types of Regular Bets | Payout |
|---|---|
| Straight or Single Duo Bets | 23 to 1 |
| Split or Two Duos Bets | 11 to 1 |
| Three Duos Bets | 7 to 1 |
| Four Duos Bets | 5 to 1 |
| Six Duos or Same Suit Bets | 3 to 1 |
| Twelve Duos or Mixed Suit Bets | 1 to 1 |

ADVANTAGES OF THE PRESENT INVENTION

Accordingly, it an advantage of the present invention is that it provides for a novel wagering card game having a wagering board and betting chips for betting on 2-card combinations that match playing cards dealt by the dealer, that can be played at gaming establishments, casinos, social gatherings, or in a home environment by a family using a standard deck of conventional playing cards.

Another advantage of the present invention is that it provides for a novel wagering card game, for betting on 2-card combinations that match playing cards dealt by the dealer, which can be played at casinos or gaming establishments, or at home as a regular board game for family enjoyment, or by utilizing existing electronic media technologies such that one or more individuals can use standard computers and software programs, video display units, video games, CD-ROM discs, laser disc games and the like for playing the game.

Another advantage of the present invention is that it provides for a wagering card game that includes all the possible, random 2-card combinations or duos that can be generated from a deck of conventional playing cards having the deletion, substitution, or addition and use of other cards with special symbols (i.e. jokers) which will alter the number of possible random 2-card combinations or duos.

Another advantage of the present invention is that it provides for a wagering game that offers the players the opportunity to make several wagering combinations with different payout odds including multiple opportunities to win or share a progressive jackpot every time a new game is played.

A further advantage of the present invention is that it provides for an exciting and interesting wagering game that is novel, yet easy to understand for the players to enjoy.

A latitude of modification, change, and substitution is intended in the foregoing disclosure,and in some instances, some features of the invention will be employed without a corresponding use of other features. Accordingly, it is appropriate that the appended claims be constructed broadly and in a manner consistent with the spirit and scope of the invention herein.

What is claimed is:

1. A method of playing a wagering board game using at least one deck of playing cards, a wagering board having a dealer position and a plurality of player positions, and each player having betting chips for betting, comprising the steps of:

a) providing a wagering board having a plurality of predetermined 2-card combinations, the cards of said 2-card combinations being identical to cards from a deck of playing cards, each of said 2-card combinations hereby defined as a board duo and thereby forming a plurality of board duos; said wagering board providing indicia for placing bets;

b) providing the dealer with a separate deck of playing cards to be used as community cards by all of the players, with indicia that are identical to the indicia of the plurality of board duos on the wagering board;

c) providing each player with a set of betting chips;

d) each player at each of said player position placing one or more betting chips on one or more of said board duos;

e) the dealer drawing the first two cards from said deck and placing them face-up on the wagering board;

f) determining if said two drawn cards make a 2-card combination that matches any one of said board duos and if a match is made, then a card duo has been drawn, and there is a matching board duo;

g) determining if any of said players have placed a bet or bets on said matching board duo, and if so, the dealer pays all winning bets, removes all losing bets, and the game ends;

h) if there has been no match, the dealer continues the game by drawing one more card and placing it face up next to the other of said face-up cards;

i) determining if any two of said three cards drawn make a card duo that match any one of said board duos, and if a match is made, then a card duo has been drawn, and there is a matching board duo;

j) determining if any of said players have placed a bet or bets on said matching board duo, and if so, the dealer pays all winning bets, removes all losing bets, and reshuffles said deck of playing cards for the next game;

k) if there has been no match, the dealer repeating step (h) until two of said cards drawn make a card duo that matches any one of said board duos on the wagering board so there is a matching board duo; and l) the dealer paying all the winning bets and removing all the losing bets to end the game.

2. A method in accordance with claim 1, further including the step of declaring a jackpot winner, if two playing cards drawn consecutively by the dealer make a card duo that match one of said board duos, then a jackpot duo has been drawn, the game ends, and if any of said players have placed bets on said board duo that matches said jackpot duo, then there is a winning jackpot board duo and the dealer pays the winning bets on said winning jackpot board duo and removes all the losing bets.

3. A method in accordance with claim 2, further including the step of said players placing bets on said jackpot board duo and on said board duos.

4. A method in accordance with claim 2, further including the step of the players placing a plurality of jackpot board duo bets and board duo bets.

5. A method in accordance with claim 2, further including the step of the players placing a plurality of jackpot board duo bets and board duo bets based on the location of the bets on the wagering board.

6. A method in accordance with claim 1, wherein said game may be played on a video machine or a computer.

* * * * *